United States Patent [19]

Detrick

[11] 3,986,714

[45] Oct. 19, 1976

[54] FINGERSTOP FOR BOWLING BALL AND METHOD

[76] Inventor: Daniel W. Detrick, 9218 Galaxie Drive, Indianapolis, Ind. 46227

[22] Filed: May 12, 1975

[21] Appl. No.: 576,588

[52] U.S. Cl. ..... 273/63 B; 215/302; 33/174 F; 215/296

[51] Int. Cl.[2] ..... A63B 43/04; A63B 37/00

[58] Field of Search ..... 273/63; 215/296, 297, 215/302; 33/174 F

[56] References Cited

UNITED STATES PATENTS 2,482,190 9/1949 Kramer ..... 273/63 A

FOREIGN PATENTS OR APPLICATIONS 1,106,988 7/1955 France ..... 215/302

*Primary Examiner*—George J. Marlo
*Attorney, Agent, or Firm*—Woodard, Weikart, Emhardt & Naughton

[57] ABSTRACT

Plugs are fitted in the thumb and fingerholes of a bowling ball so that when the fingertip enters it will touch the plug at the precise time that the finger has reached the depth found by the bowler to be most comfortable and satisfactory. The plug has a spiral passageway therein useful with a spiral removal tool for repeated non-destructive removal of the plug for cutting it to shorten it, followed by re-installation of the plug and eventual sealing in the hole when the proper fit is achieved.

14 Claims, 6 Drawing Figures

FINGERSTOP FOR BOWLING BALL AND METHOD

BACKGROUND OF THE INVENTION

1. Field of the Invention

This invention relates generally to bowling equipment, and more particularly to apparatus and a method for better fitting the ball to the hand of the user.

2. Description of the Prior Art

I believe that some efforts have been made in the past to improve the fit of a bowling ball to the hand of the bowler. Some thought has been given to use of filler materials, but those which remain in a loose state are objectionable from the standpoint of possible loss from the ball itself resulting in weight change or shift. Others involving metal are objectionable because inacceptable for competition bowling. There remains a need for something which the bowler himself can use and fit at his convenience and yet which will meet requirements for competition in bowling in leagues and otherwise.

SUMMARY OF THE INVENTION

Described briefly, in a typical embodiment of the present invention, plugs are installed in the thumb and fingerholes of a bowling ball and adjusted in length so that, when the plugs are at the bottom of the holes, and the bowler's fingers just touch them, the hand of the bowler is at the location best suited to him or her for consistent good bowling. The plugs are provided with removal tool receiving means therein facilitating repetitive non-destructive removal from the ball for trimming to fit and suit the desired fingerhole depth for the bowler, and yet accommodate re-insertion and eventual sealing of the plug in the hole.

DESCRIPTION OF THE PREFERRED EMBODIMENT

Figure 1:
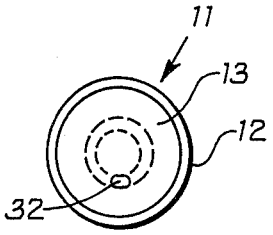
FIG. 1 is an axial end view of a plug according to a typical embodiment of the present invention.
Figure 2:
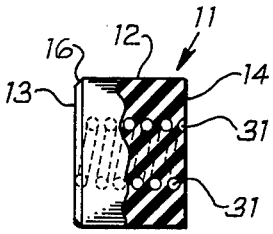
FIG. 2 is a side view thereof, partially broken away in section to show the interior detail.

Referring now to the drawings in detail, and particularly FIG. 1, the plug 11 is generally cylindrical in character, the diameter of the outer cylindrical surface 12 being such as to effect a press fit in the particular fingerhole of the bowling ball in which it is to be used. Hereinafter, the term fingerhole should be considered to encompass also the thumbhole, unless specifically identified otherwise. The amount of press is about 1/64 inch on the diameter. The diameters will typically range from 21/32 inch to 1⅛ inch for the various sizes of fingerholes normally encountered in bowling. As shown in FIG. 2, the overall length from the upper end 13 to the lower end 14 will be originally approximately three-fourths inch and will be trimmed shorter according to the needs of the bowler as will be described hereinafter. A chamber of 1/16 inch by 45° will be provided at the upper end 13 as shown at 16. The material typically in GRS butadienestyrene. Other reasonably resilient durable flexible materials may also be used.

Figure 3:
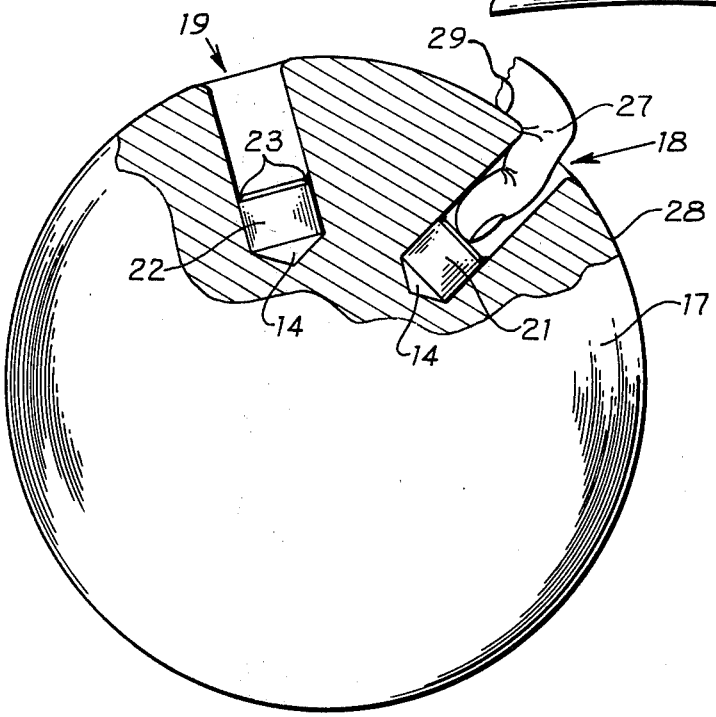
FIG. 3 is a view of a bowling ball with a portion thereof in section to show a finger and thumbhole with the plugs installed therein.

Referring now to FIG. 3, the bowling ball 17 is shown with a section broken illustrating a fingerhole 18 and thumbhole 19. Both of these holes are drilled in the ball is conventional manner and to conventional depth. The bottom of each hole has the typical conical configuration of a drill point. Plug 21 is shown in the fingerhole and plug 22 is shown in the thumbhole. It will be observed that the bottom 14 of each plug is at the bottom of the respective hole in which it is disposed and the plug is sealed in the hole by a ring of adhesive at 23, epoxy material being well suited for this purpose. The epoxy is applied to the plug in the hole after fitting in a manner which will be described hereinafter. Note that it is located where the chamber of the plug meets the cylindrical surface of the fingerhole.

Figure 4:
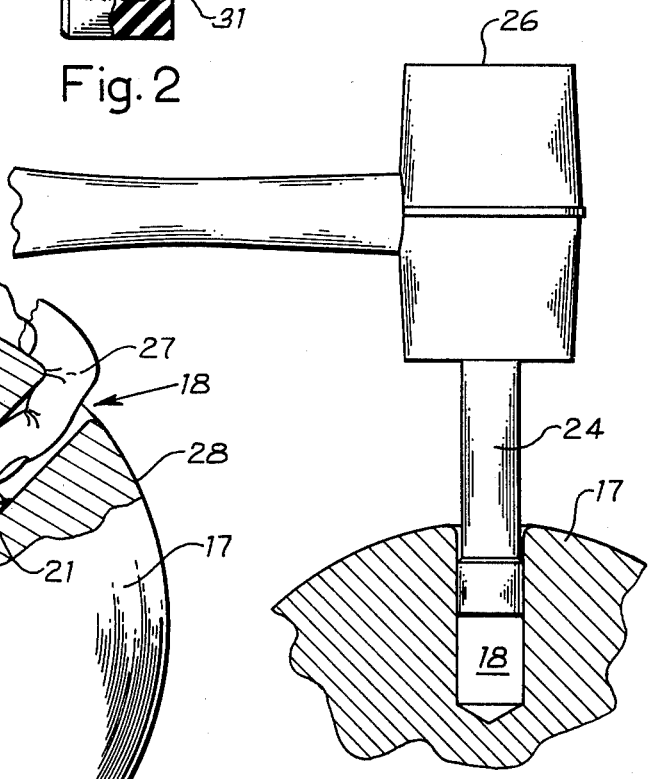
FIG. 4 is a fragmentary sectional view of a ball showing the installation of a plug with a hammer and bar.
Figure 5:
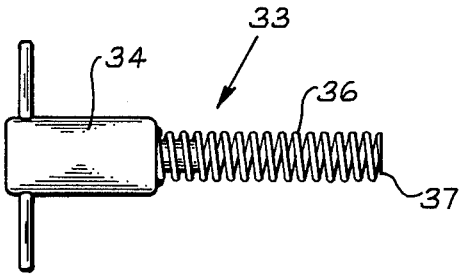
FIG. 5 is an elevational view of the plug removal tool.

To install a plug in a hole, one method is to use a bar or rod 24 as shown in FIG. 4 and drive the plug in the hole with a hammer 26. When the plug has reached the bottom of the hole, the bowler places the appropriate finger in the hole and, if the second knuckle such as knuckle 27 in FIG. 3 is spaced away from the peripheral surface 28 of the ball, most bowlers would consider this hole as plugged to be too shallow. The objective is to have the fingertip just touch the top 13 of the plug when the second knuckle is at the surface of the ball so the finger can be bent virtually flush with the ball at 29 without any unusual effort as the ball rests on a surface. Some bowlers may prefer different plug heights, but in any event, the provision of the plug in the present invention will enable the bowler to bottom out his fingers each time he uses the ball and thus attain a uniformity of grip.

As indicated above, if the hole is too shallow upon first trail, then the plug can be removed. For this purpose, and according to a novel feature of the invention, a spiral passageway 31 is provided in the plug. This passageway is molded in the plug by using a coil spring inside the plug as the plug is molded. The entrance to the passageway is manifest in the top of the plug as merely a slit or perforation at 32 in FIG. 1. The passageway extends from the top of the plug to the bottom of the plug.

Figure 6:
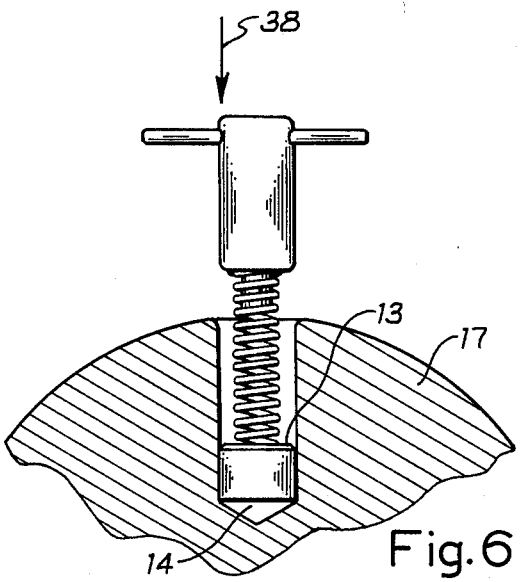
FIG. 6 is a fragmentary section through the ball as in FIG. 4, but showing the removal tool in use for removal of the plug.

To remove the plug from the fingerhole without destroying the plug, the special tool 33 of the present invention is employed. This tool employs a T-handle 34 to which a spiral 36 is affixed. The spiral may be an open coil spring and the distal end turn is rounded as at 37 to avoid tearing the passageway and to facilitate insertion of the tool in the plug. Its use is shown in FIG. 6 where, when viewed from above in the direction of arrow 38, the tool is turned into the plug in a clockwise direction. Thus it advances from the top 13 of the plug to the bottom 14 of the plug while the plug remains snug in the hole by reason of the 0.016 press fit. Once the tool has been screwed into the hole so that it extends throughout the entire passageway to the bottom of the plug, then the tool is pulled directly out of the hole in the direction opposite arrow 38, and without turning the tool to pull the plug from the hole. If desired, the tool could continue to be turned in the clockwise direction and in effect screw the plug out of the hole.

In the use of the invention, the bowler installs plugs in each of the three holes typically found in bowling balls. It can be used in a two-hole ball or in a five-hole ball. If the bowler finds that the plugs as originally furnished make the holes much too shallow, he can immediately remove them by the use of the tool 33 and cut or trim material off the bottom ends of the plugs by the use of knife or razor blade or the like. Then he again installs the plugs in the holes by the use of the method of FIG. 4, for example. If the depth seems about right, he may wish to try out the ball, by bowling some frames with it. If the holes are still too shallow, he may use the tool to again remove and trim the plugs as needed. He can continue the procedure and bowl with the ball to the extent he needs, until he obtains the depths of the plug tops which seen to be most suitable to him. Thus he continues to remove, trim, and re-install until all plugs serve to locate his fingers most comfortably and enable him to deliver virtually the same throw of the ball each time. He then inserts the adhesive around the circumference of each plug at the chamfer thereon to affix it in place. After the adhesive is set, he is then ready to bowl, and the assembly meets the rules for league and competition bowling. Epoxy can also fill the spiral passageway if desired.

It will be observed that by virtue of the use of the novel spiral passageway in the plug, and which itself is snug on the tool once the tool has been inserted, the plug can be reliably and repeatedly removed during the fitting operation, without destroying the plug. Nevertheless, once installed, there is practically no perceivable aperture or cavity in the plug. In other words, the bowler can rely on reliable repeated abutment of his fingertips with the center of the plug. Typically, the top of the plug, after trimming, will be located more than half the distance from the periphery of the ball to the bottom of the hole. In some instances, where a finger is unusually short, the top or outer end may be less than half the disance to the bottom of the hole. Although the adjustment tool is in the shape of a spring, the spring characteristic is not needed in the sense that the tool should not perceivably deform in length during installation of the tool or removal of the plug therewith. Furthermore it should not wind up or unwind as it is being inserted in or removed, respectively, from the plug. In other words, the tool should be comparatively stiff, and if a spring is used for the tool, it should exhibit minimal springy characteristics when employed in use for the purposes of this invention. The outside diameter of the tool is approximately one half inch at the spiral portion, and the wire diameter is approximately 1/16 inch. The wire diameter of the coil used in the making of the mold is approximately 0.082 inches, thus resulting in a spiral passageway which will be snug on the 1/16 inch diameter spring wire. A 0.070 inch wall thickness of the plug between the outside of the passageway therein and the outer cylindrical surface of the plug, is adequate.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

WHAT IS CLAIMED IS:

1. For improved bowling, the combination comprising:

a generally cylindrical body with a spiral passageway therein and an outside diameter small enough to be fittingly received in a fingerhole of a bowling ball.

2. The combination of claim 1 wherein:

said body is made of flexible resilient material.

3. The combination of claim 1 wherein:

said spiral passageway is helical and coaxial with the cylindrical axis of said body and of uniform diameter.

4. The combination of claim 1 and further comprising:

a bowling ball having a fingerhole therein; said body being snugly fitted in said hole.

5. The combination of claim 4 wherein:

said body is seated at the bottom of the hole and extends outwardly to a point less than half of the distance to the outside of the ball.

6. The combination of claim 5 wherein:

said body is affixed to said ball, in the hole by means of an adhesive at the outer face of said body.

7. The combination of claim 6 and further comprising:

a second fingerhole in said bowling ball;

a second body seated at the bottom of said second fingerhole and having a top located more than half the distance from the outside of the ball to the bottom of said second fingerhole, for a fingertip stop.

8. The combination of claim 4 in which the cylindrical axis of said body extends through a first and second end of said body, said spiral passageway extending through said body and communicating with each of said first and second ends.

9. The combination of claim 8 in which said spiral passageway is the only passageway in said body which communicates with each of said first and second ends.

10. A method of locating a fingertip in a bowling ball comprising the steps of:

a. placing a plug temporarily in a fingerhole of a bowling ball;

b. pulling the plug from the hole with a spiral extractor;

c. cutting the plug;

d. forcing the plug into the fingerhole again; and e. sealing the plug in place.

11. The method of claim 10 and further comprising the step of:

threading a spiral extractor into the plug in the hole prior to pulling the plug.

12. The method of claim 11 wherein the step of threading the extractor comprises:

threading the extractor entirely through the plug before pulling the plug.

13. The method of claim 10 wherein:

steps *b*) *c*) and *d*) are repeated with the plug at least once before step *e*).

14. The method of claim 10 wherein:

steps *a*) *b*) *c*) *d*) and *e*) are performed for additional fingerholes in the ball.

* * * * *